US009247792B1

(12) United States Patent
Smith

(10) Patent No.: US 9,247,792 B1
(45) Date of Patent: Feb. 2, 2016

(54) ORGANIC JEWELRY AND METHOD OF FABRICATION

(71) Applicant: Mary N. Smith, Mohawk, NY (US)

(72) Inventor: Mary N. Smith, Mohawk, NY (US)

( * ) Notice: Subject to any disclaimer, the term of this patent is extended or adjusted under 35 U.S.C. 154(b) by 0 days.

(21) Appl. No.: 13/744,410

(22) Filed: Jan. 17, 2013

Related U.S. Application Data

(60) Provisional application No. 61/587,704, filed on Jan. 18, 2012.

(51) Int. Cl.
*A44C 27/00* (2006.01)
*A44C 17/00* (2006.01)

(52) U.S. Cl.
CPC ..... *A44C 27/007* (2013.01); *A44C 17/007* (2013.01)

(58) Field of Classification Search
CPC .... A44C 27/00; A44C 27/001; A44C 27/005; A44C 27/007; A44C 27/002
USPC ..... 29/896.41, 896.4, 896.411, 896.412, 29/896.43; 63/34, 33, 36
See application file for complete search history.

(56) References Cited

U.S. PATENT DOCUMENTS

| | | | | |
|---|---|---|---|---|
| 1,779,299 | A | 10/1930 | Valentine | |
| 2,658,836 | A | 11/1953 | Fessenden | |
| 2,906,636 | A | 9/1959 | Hoivik | |
| 3,607,488 | A | 9/1971 | Yordan | |
| 4,094,845 | A | 6/1978 | De Long | |
| 4,293,602 | A | 10/1981 | Coffey et al. | |
| 6,033,701 | A * | 3/2000 | Hirsch | 426/268 |
| 2010/0275649 | A1 * | 11/2010 | Eggleston | 63/1.14 |

OTHER PUBLICATIONS

Home & Garden Television, "Drid Fruit Orange Necklace", http://www.hgtv.com/crafting/dried-fruit-orange-necklace/pictures/index.html, 2014, 2 pages.
Kelly, "How to Turn Fruit and Vegetables Into Jewelry", http://www.ehow.com/how_5892488_turn-fruit-vegetables-jewelry.html, Dec. 17, 2013, 4 pages.
la prochaine fois, "dried fruit rings", http://laprochainefois.blogspot.com/2009/05/dried-fruit-rings.html, May 18, 2009, 26 pages.
Dorfman, "Uncommon Goods: Products & Artist Bio", http://www.uncommongoods.com/artist?artistId=369, 2014, 2 pages.

* cited by examiner

*Primary Examiner* — Christopher Besler
(74) *Attorney, Agent, or Firm* — Maxine L. Barasch; Keohane & D'Alessandro PLLC

(57) ABSTRACT

Embodiments of the present invention provide a method for fabricating jewelry that has an organic component. The organic material may comprise fruit, vegetables, leaves, stalks, flower petals, or any other suitable organic materials or combination thereof.

24 Claims, 9 Drawing Sheets

ORGANIC JEWELRY AND METHOD OF FABRICATION

CROSS REFERENCE TO RELATED APPLICATIONS

This application claims priority to U.S. Provisional Patent Application No. 61/587,704, filed Jan. 18, 2012. The aforementioned provisional patent application is hereby incorporated by reference in its entirety.

FIELD OF THE INVENTION

The present invention relates generally to jewelry making, and more particularly, to making jewelry comprising real fruits and vegetables.

BACKGROUND

Fruits and vegetables provide various aesthetic qualities. It is therefore desirable to have improved jewelry pieces utilizing fruits and vegetables, and methods for fabrication.

SUMMARY

Embodiments of the present invention provide a method for fabricating jewelry comprising organic material.

In one embodiment, the method uses fruit or vegetables.

In another embodiment, the method comprises: preserving the organic material; forming the organic material; applying an anti-browning chemical to the organic material; applying a silica treatment to the organic material; and applying a clear resin to the organic material.

In another embodiment, the method comprises: drying the organic material in a dehydrator at a temperature ranging from about 130 degrees Fahrenheit to about 155 degrees Fahrenheit.

In another embodiment, the method comprises: grinding raised portions of the organic material to create a flat surface comprising ground portions; and applying a clear resin to the ground portions of the organic material.

In another embodiment, the method comprises: applying an anti-stick coating to a drying board comprising a plurality of hooks; hanging the jewelry on the plurality of hooks; and repositioning the jewelry after a predetermined time interval to avoid adherence of the jewelry to the drying board.

In another embodiment, the method comprises: forming a piece of sculpture wire into a formed shape; applying preserved organic material to the formed shape; and applying a clear resin to the preserved organic material.

In another embodiment, a jewelry piece is provided, comprising: a metal portion comprised of sculpture wire; an organic portion affixed to the metal portion; and a clear resin layer disposed on the organic portion.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION

Embodiments of the present invention provide a method for fabricating jewelry that has an organic component. In particular, the organic component may be a fruit or vegetable. For the purposes of this disclosure, the term "organic material" is primarily used in the following examples and description. The organic material may comprise fruit, vegetables, leaves, stalks, flower petals or any other suitable organic materials or combination thereof.

Figure 1:
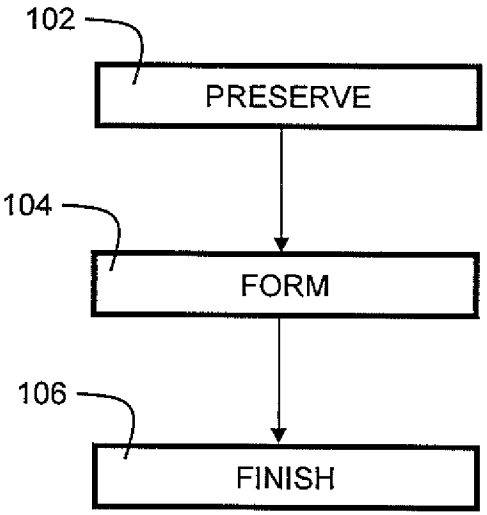
FIG. 1 is a flowchart indicating process steps for a method in accordance with an embodiment of the present invention.

FIG. 1 is a flowchart indicating process steps for a method in accordance with an embodiment of the present invention. In process step 102, the organic material is preserved. In process step 104, the organic material is formed into the desired shape for the jewelry. In process step 106, the jewelry is finished, which entails various steps for cosmetic purposes to finalize the jewelry piece.

Figure 2:
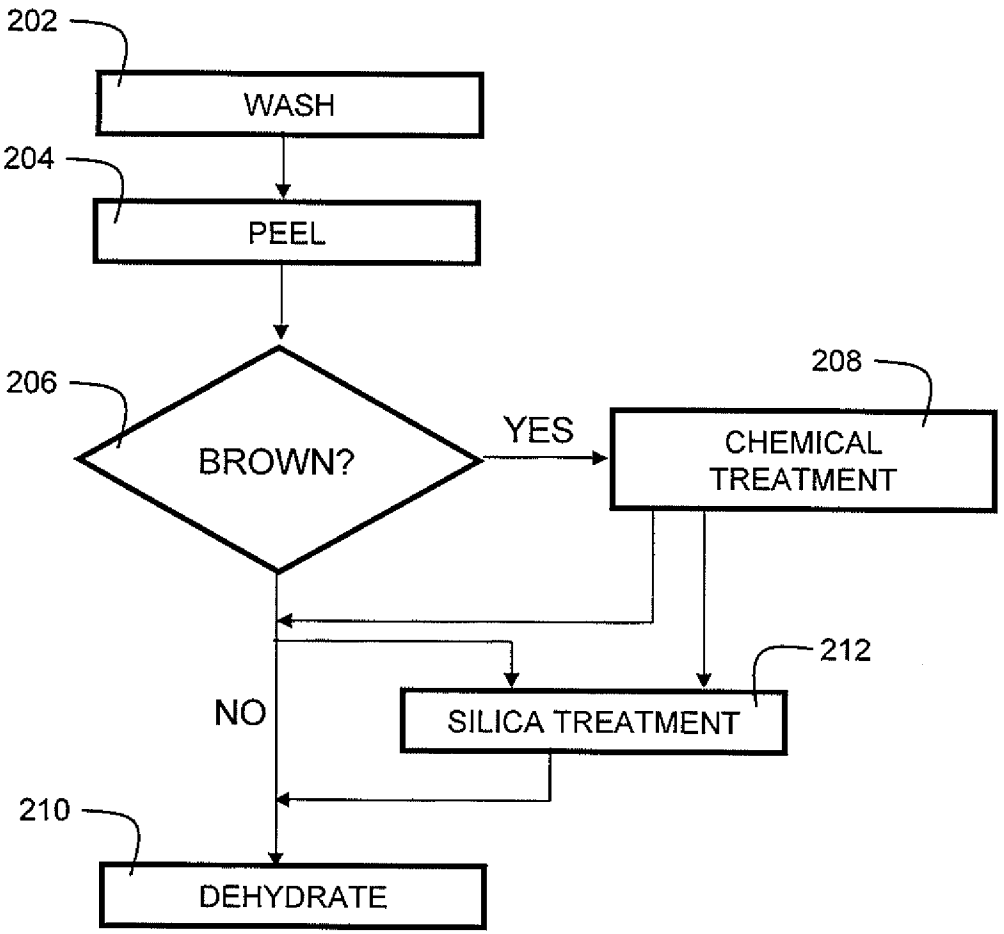
FIG. 2 is a flowchart indicating process steps for a method in accordance with an embodiment of the present invention, showing details of the preservation process.

FIG. 2 is a flowchart indicating process steps for a method in accordance with an embodiment of the present invention, showing details of the preservation process. In process step 202, the organic material is washed. The organic material may be washed with, for example, water, or a mixture of soap and water. It will be recognized that in some embodiments, other washes could be used, and the invention includes all feasible washing agents. In process step 204, the organic material (if applicable, e.g., in the case of a kiwi) is peeled to remove the skin. In step 206, an evaluation is made to see if the organic material is of a type that is prone to turning brown or withering when cut and/or dehydrated (e.g., an apple). If prone to browning or withering, the process proceeds to step 208 for an anti-browning chemical treatment.

In one embodiment, the anti-browning and anti-withering chemical treatment may comprise Dri Splendor Silica Gel Fresh Flower Preservative (Miracle Coatings, Orange, Calif.), which is very effective because it is comprised of crystals that make it easier to manipulate than more sand-like products. This silica treatment process may be applied in process step 212. In some embodiments, the silica treatment comprises pouring a layer of silica-gel crystals into a microwave-safe container. Next, the organic material is arranged over the crystals in a single layer, such that none of the pieces of organic material are in contact with one another. More silica gel is then poured over the organic material until fully covered. The container is placed in a microwave oven for, e.g., between 1 and 3 minutes. In one embodiment, the microwave oven settings are full power for 1 minute. Next, the organic material is allowed to cool, and then checked to determine the level of dehydration. If necessary, the organic material may be placed in the microwave for additional time to achieve the desired dryness.

In another embodiment, the anti-browning treatment may comprise a citric acid water bath. Vegetables with a high degree of starch require at least 1 teaspoon of Citric Acid added per one gallon of water as a bath completely covering all vegetable slices. The length of time the vegetable must be subjected to the citric acid water bath depends varies depending on the vegetable and the desired color. The anti-browning treatment prevents immediate browning or grey to black discoloration from occurring during the drying or silica treatment process. Also any vegetable that is white or off white in color requires this treatment as well.

It will be recognized that any suitable anti-browning and anti-withering agent is included within the scope of the invention. In some embodiments, only a silica treatment is used. In some embodiments, only a citric acid water bath is used. In some embodiments, both a citric water bath and a silica treatment is used.

If the organic material is not particularly prone to browning (e.g., a carrot), then the process proceeds to step 210, where the organic material is dried, for example, in a dehydrator. The dehydrator subjects the organic material to a dry environment at elevated temperatures (e.g., without limitation, in the range of about 130 degrees Fahrenheit to about 155 degrees Fahrenheit).

Figure 3:
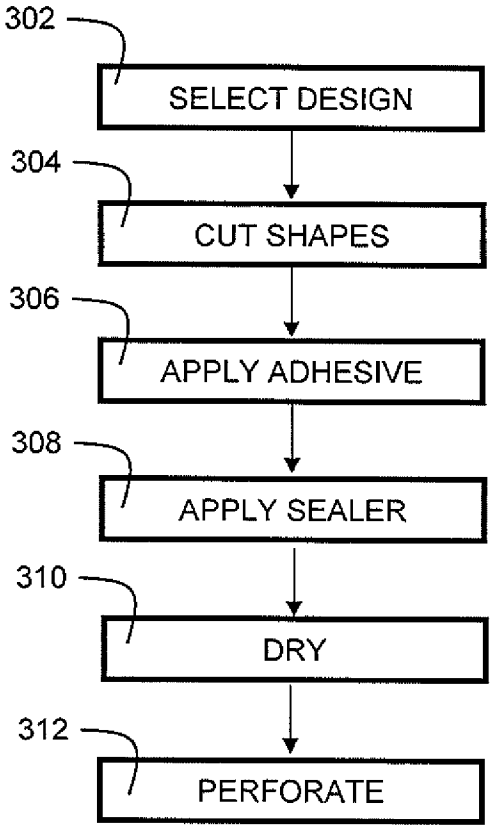
FIG. 3 is a flowchart indicating process steps for a method in accordance with an embodiment of the present invention, showing details of the forming process.
Figure 7:
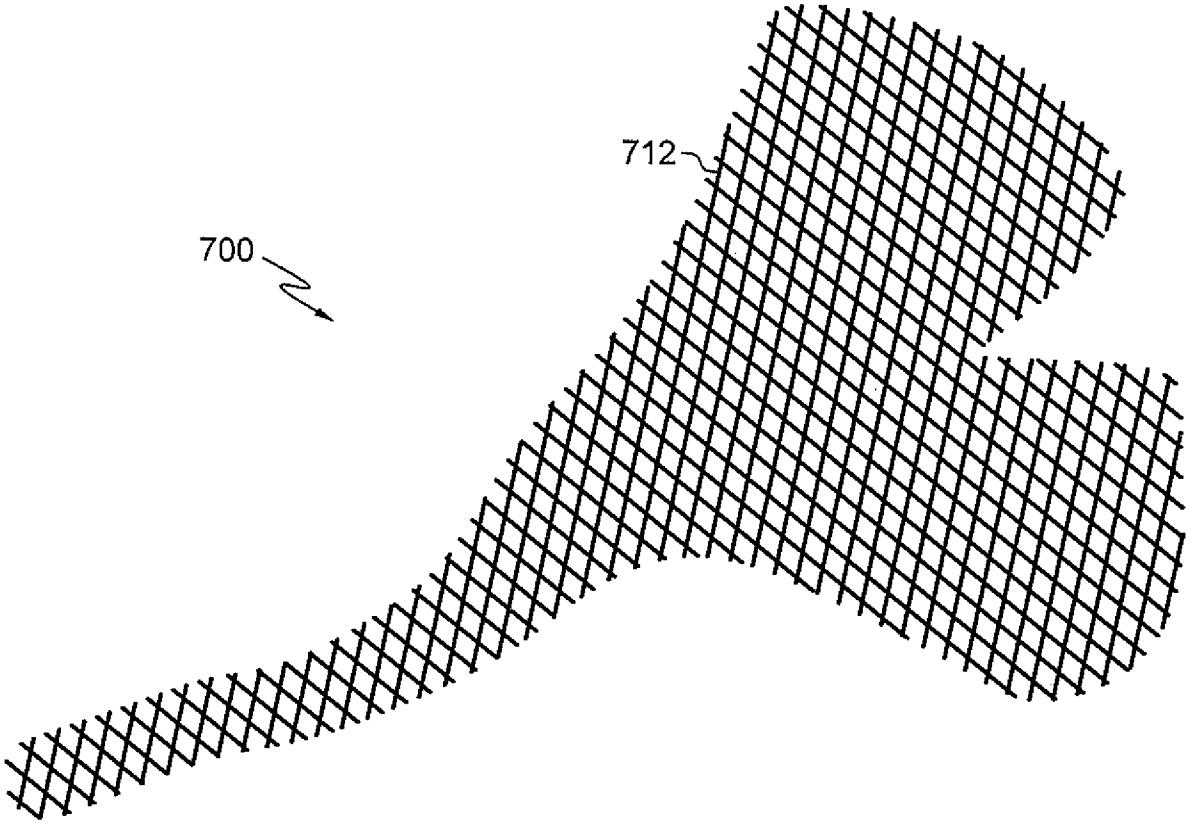
FIG. 7 shows a wire form for another embodiment of the present invention.
Figure 9:
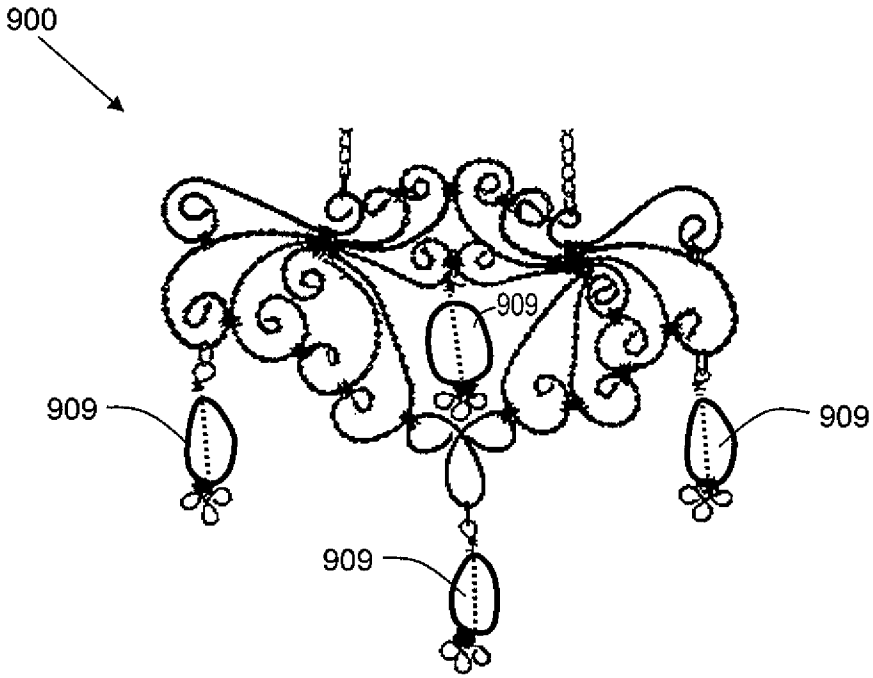
FIG. 9 shows a piece of jewelry in accordance with yet another embodiment of the present invention.

FIG. 3 is a flowchart indicating process steps for a method in accordance with an embodiment of the present invention, showing details of the forming process. In process step 302, a blank design is chosen. The blank may comprise, for example, copper, aluminum or other suitable material or combination thereof, depending on the desired color to be achieved with the finished product. The blank shape may be a solid shape, for example, a bracelet, ring, necklace, or other suitable piece of jewelry. In the case of a bracelet, if the bracelet blank is flat, a manual bracelet bender tool, or other suitable device, may be used to bend the bracelet blank into a bracelet shape. For a ring, the blank of which is flat, a similar process is followed, forming a ring shape with a Wrap and Tap tool or other suitable device. It will be recognized that in some embodiments, the ring or bracelet may be pre-formed as a single contiguous loop (for example, similar to a bangle) in which case shaping would then not be necessary. In some embodiments, the blank is sculpture wire in a desired shape, an example of which is shown in FIG. 7. In some embodiments, the blank is created by shaping jewelry wire into a desired shape, an example of which is shown in FIG. 9, to create negative space.

In process step 304, the organic material is cut into the desired shapes for the piece of jewelry. In process step 306, an adhesive, for example, but not limited to, Mod Podge glue, is applied with a foam brush to the blank and/or the organic material back as necessary to bond the organic material to the blank. It will be recognized that all suitable adhesives and combinations thereof are included within the scope of the invention. In process step 308, a sealer coat, e.g., of glue, may be applied to some portions or the entire piece of organic material still accessible for such application (for example, the side of organic material glued to the blank would not be accessible for application of the sealer coat). In some embodiments, the full blank is covered with organic material, and in some embodiments, the blank is partially covered, to leave some of the blank in view. In the case that the blank is jewelry wire, the organic material is affixed to fit into the negative spaces of the jewelry wire shape. The organic material may be affixed by friction fit, or adhering to the wires of the blank, adhering to other pieces of organic material, or any combination thereof. In process step 310, the jewelry is let to dry for a period in the range of, for example without limitation, 12 to 24 hours. In one embodiment, the blank and adhesive are both organic materials.

In the case of a necklace, both sides of the organic material have adhesive (such as, but not limited to, Mod Podge Glue (Plaid Enterprises, Norcross, Ga.) applied to them. Then a hook is formed from jewelry wire with pliers. The hook comprises an S-shaped hook, e.g., made from silver, copper, or other suitable material. It will be recognized that the hook may comprise alternate colors or shapes, and all feasible colors and shapes are within the scope of the invention. In process step 312, if applicable, the organic material is perforated to form a hole in which the S hook or hooks are secured in place before moving to the next phase of the process. It will be recognized that instead of a hook, another suitable device may be used, such as a loop comprised of string.

Figure 4:
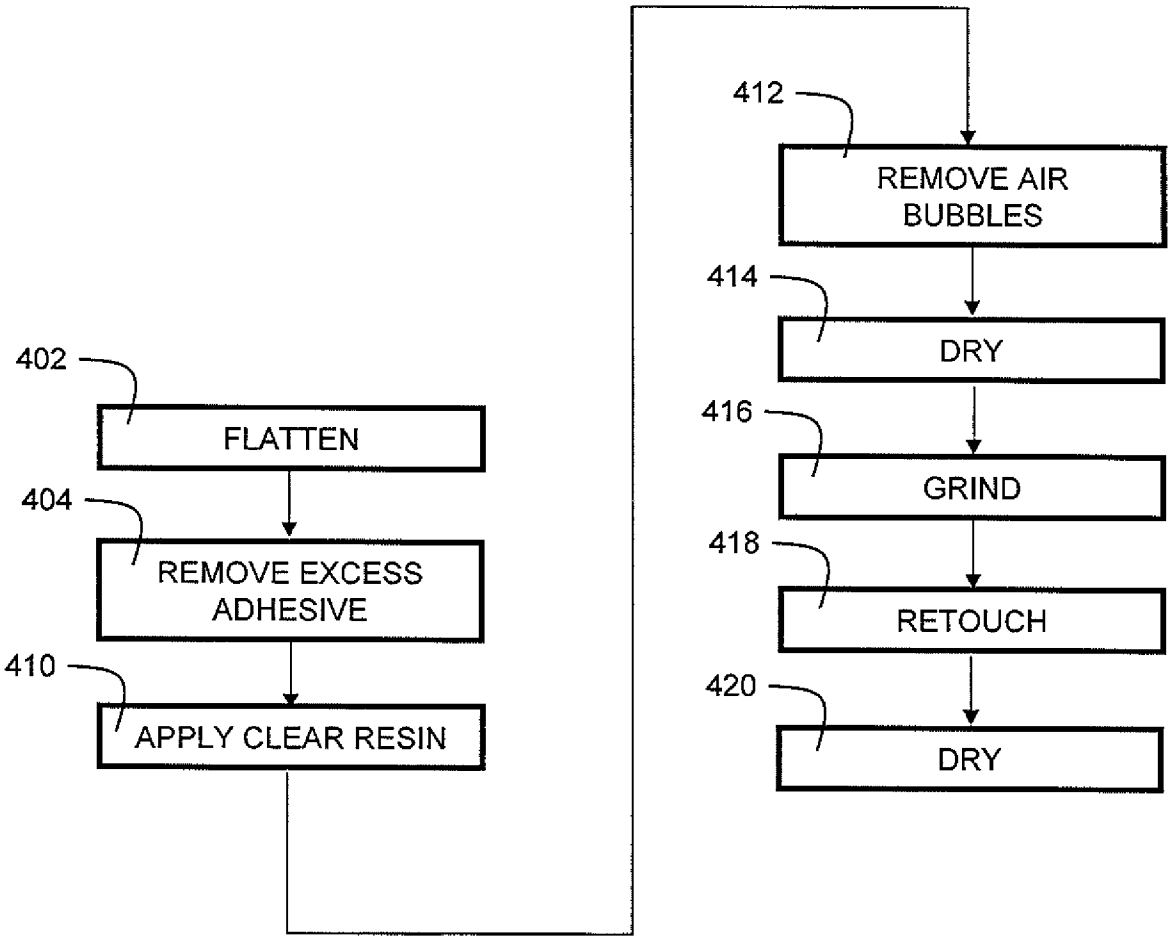
FIG. 4 is a flowchart indicating process steps for a method in accordance with an embodiment of the present invention, showing details of the finishing process.

FIG. 4 is a flowchart indicating process steps for a method in accordance with an embodiment of the present invention, showing details of the finishing process. In process step 402, the organic material is flattened (if necessary). This may include pushing down all hard edges by hand to be as flat as possible. It will be recognized that any suitable method of flattening may be substituted for the one disclosed here, and as such, are included within the scope of the invention. In process step 404, any excess adhesive is removed, if any (from step 306).

In process step 410, a clear resin is applied. Preparation of the resin may comprise making a 1:1 mixture of resin to hardener in a receptacle, such as a plastic cup. The mixture may then be stirred to fully mix the resin and hardener. The mixing process typically includes scraping the bottom of the container frequently. In some embodiments, the resin must be used within 25 minutes from preparation as after that, the resin takes on a consistency too hard to work with. In one embodiment, the resin is UVPoxy Clear (EcoPoxy Systems, Providence, R.I.), and the hardener is UVPoxy Hardener (EcoPoxy Systems, Providence, R.I.). UVPoxy Clear and UVPoxy Hardener are each all-natural, made from soybeans, beans, and peanuts. They are each 100% solid, odorless, and do not contain heavy metals or toxic organic compounds. Long bent pliers, or any other suitable device, may be used to dip each bracelet into the mixture, turning to coat all surfaces, and holding to allow excess resin to drip back into the receptacle. Resin may be applied, to one or both sides of the piece. Resin gives the piece shine, waterproofing, and durability.

In step 412, any air bubbles formed in the resin are removed, for example, by an air current (such as from a fan or blower) is applied to the jewelry to pop any air bubbles that may form in the resin. In process step 414, the jewelry is left to dry. In some embodiments, the jewelry is let to dry for at least 24 hours. In this step, the jewelry is placed on, and allowed to hang from, nail points of a nail head drying board. Once the finish becomes very tacky, the jewelry is repositioned to minimize nail marks. It is preferable that prior to hanging the jewelry, that the nail points be sprayed with anti-stick coating, such as Pam (ConAgra Foods, Inc., Omaha, Nebr.) or other suitable material. In process step 416, any drips or pooled areas on the ends of the jewelry piece (e.g., bracelet) are ground down, as well as any rough spots created by nail end points or by the organic material itself. In one embodiment, the grinding is performed with a Flex Shaft tool (Dremel, a division of Robert Bosch Tool Corporation, Arlington Heights, Ill.) and tiny grinding head. In process step 418, the jewelry is retouched by applying clear resin to areas that were ground in the previous process step. In some embodiments, resin may be applied to the entire piece, for example, adding a second coat over the original coat of resin.

In process step 420, a final drying step is performed to allow the resin used in the previous step to dry.

Figure 5:
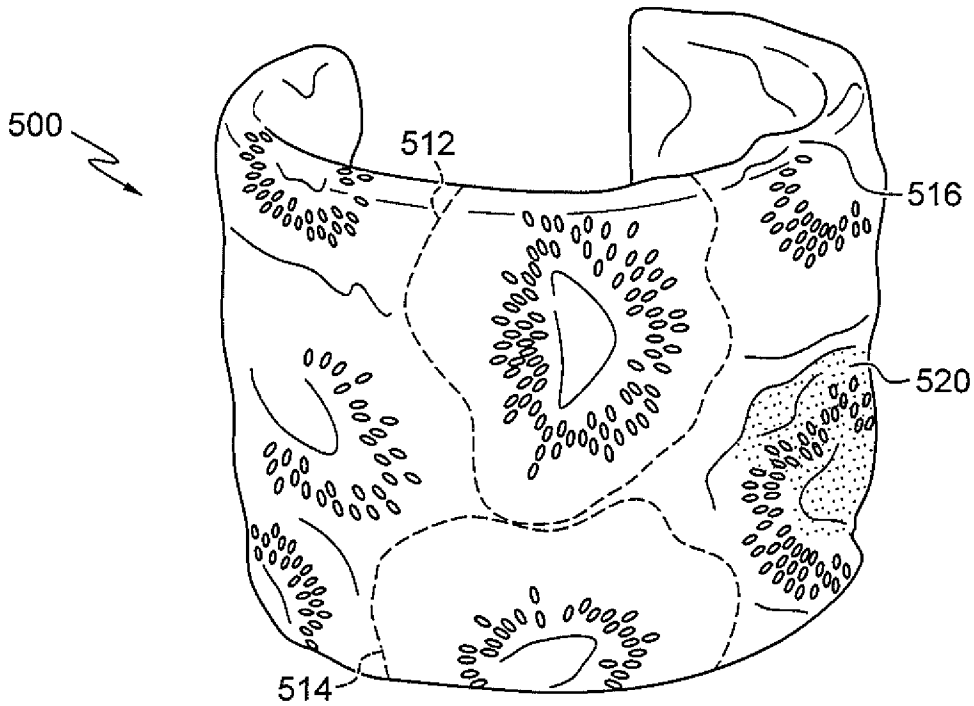
FIG. 5 shows a piece of jewelry in accordance with an embodiment of the present invention.

FIG. 5 is a piece of jewelry 500 in accordance with an embodiment of the present invention. Jewelry item 500 is a bracelet. A plurality of kiwi slices, shown generally as 512 and 514 are affixed to a metal bracelet loop 516. The kiwi slices have been dried and treated by the aforementioned processes such that they are preserved and durable, while maintaining an appearance of a freshly sliced kiwi. Other fruits, vegetables, and other plant forms may also be used to form jewelry by methods of the present invention. These include, but are not limited to, cabbage, beets, carrots, apples, oranges, limes, lemons, pears, plant stalks, leaves, flower petals, and any other suitable organic material.

Figure 6:
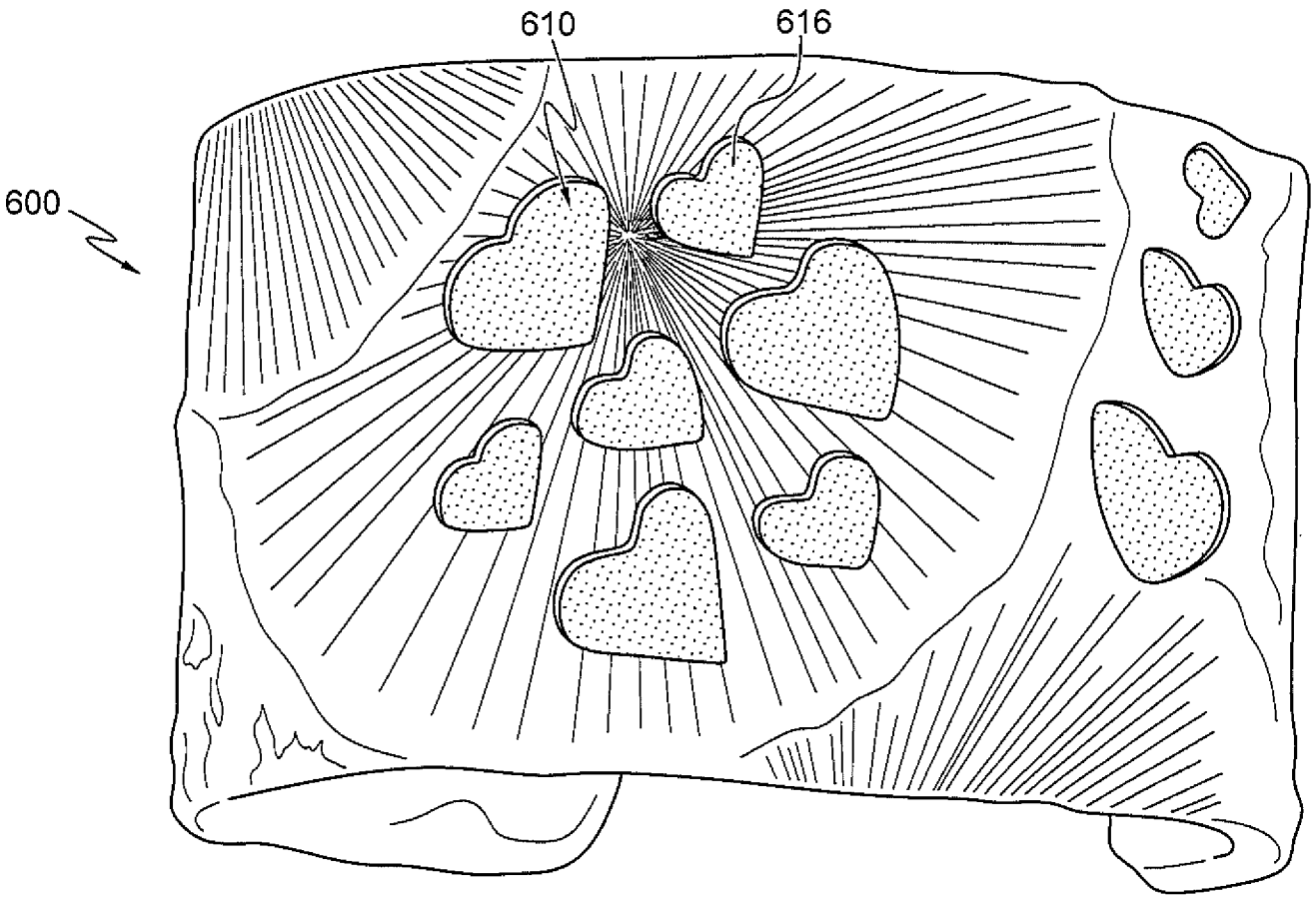
FIG. 6 shows a piece of jewelry in accordance with another embodiment of the present invention.

FIG. 6 shows a piece of jewelry 600 in accordance with another embodiment of the present invention. This embodiment is similar to embodiment 500 of FIG. 5, except that one or more portions (indicated generally as 610) of the organic material are removed to reveal the bracelet blank 616. This provides an additional decorative element to the jewelry. While bracelet 600 shows a plurality of "heart" shaped portions 610 of organic material removed, other shapes, such as stars, crescents, crosses, squares, circles or any other suitable shapes or combination thereof may also be used.

FIG. 7 shows a wire form 700 for another embodiment of the present invention. The wire form 700 is formed from a sheet of sculpture wire 712. The sculpture wire 712 is cut and formed into the desired shape for a piece of jewelry.

Figure 8:
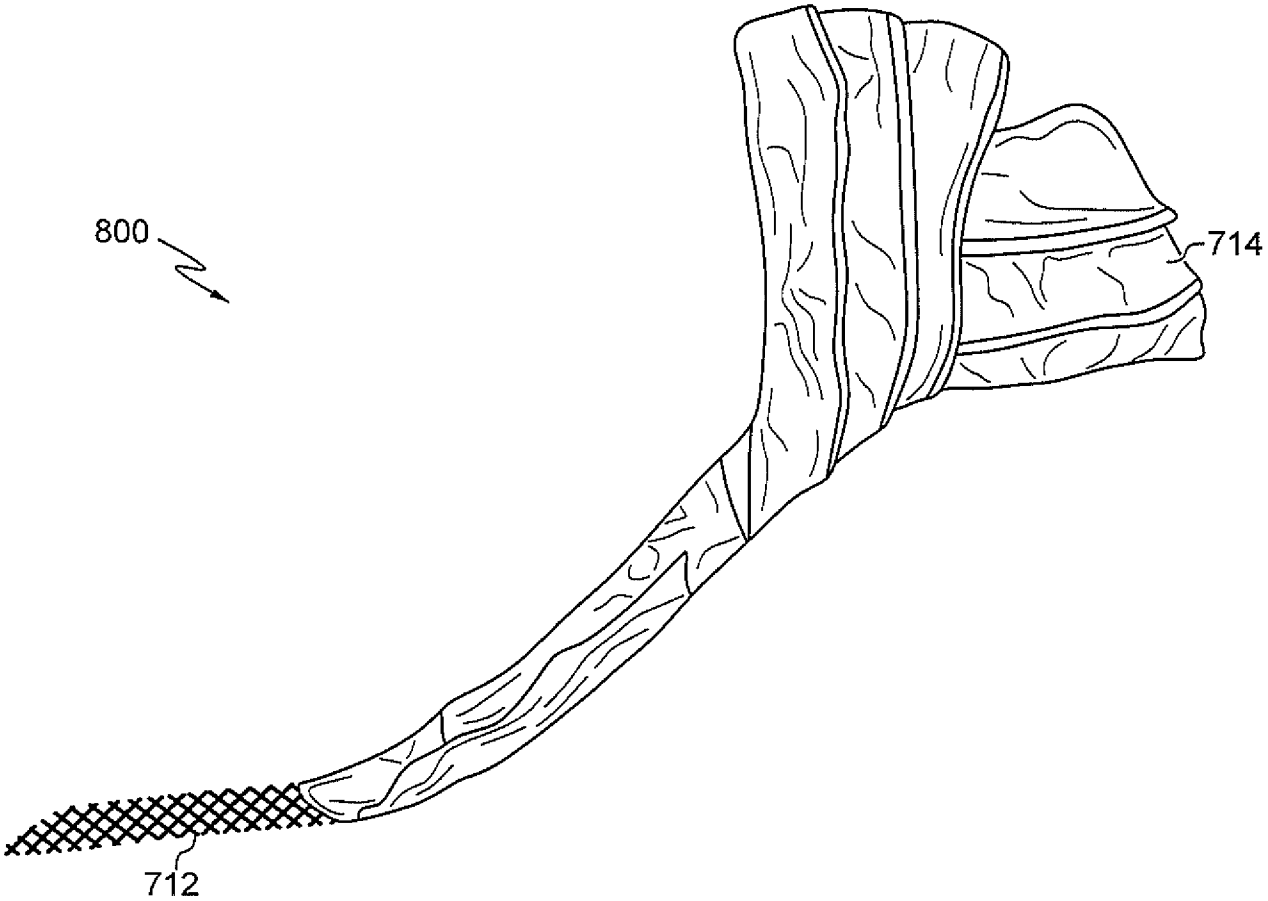
FIG. 8 shows a piece of jewelry in accordance with another embodiment of the present invention.

FIG. 8 shows a piece of jewelry 800 in accordance with another embodiment of the present invention. Pieces of thinly sliced, preserved organic material (dried fruit or vegetables) 714 are applied to the sculpture wire 712. The pieces of preserved organic material 714 may completely cover the sculpture wire 712, or alternatively, uncovered portions of the sculpture wire 712 may be removed.

FIG. 9 shows a piece of jewelry 900 in accordance with another embodiment of the present invention. The blank is created by shaping jewelry wire into a desired shape. The organic material 909 is affixed (e.g., glue) to fit into the negative spaces of the jewelry wire shape. Resin is then applied, typically, to both sides, and the piece is allowed to dry. This creates a piece of jewelry resembling a stained glass piece.

A variety of different types of fruits and vegetables may be used for forming jewelry pieces in accordance with embodiments of the present invention. The methods used for making the jewelry may vary depending on the type of fruit or vegetable used. Some exemplary embodiments with specific fruit or vegetable types are listed below:

Beets (White Beet, Red Beet, Chiota (Candy Striped Beet), Golden Beet, Bull's Blood Beet, Giant Beet Yellow, Red Varieties)

All white or light fleshed beets require citric acid preparation. May also use the citric acid bath on red beets to keep color lighter to keep deep reds versus almost black by the end of heated drying. Citric acid bath used on red fleshed beets can be used to dye white or yellow beets to create interesting "tie dye" colored effects. Putting Golden beets in fresh citric acid bath for at least 15-20 minutes will amplify to a deep golden colored flesh as it steeps in its own coloring. Dry beets at a max temp of 125 degrees F. for a full 10 drawer dryer load, beginning to test for full dry by the two hour mark. Remove beets as they start to feel dry and before they become shriveled and hard which causes them to disintegrate easily. Preserving golden beets directly from slicing to silica single layer treatment in microwave creates an interesting {"petrified wood" look of light gold and grey swirled coloring. Bull's blood beets have white tips on the textured rings inside the deep red beet which causes an interesting pattern when fully dried. Altering the plane on which Chiota (candy striped beets) are cut on creates a never ending unique pattern of the red and white flesh which is very desirable. All white and Chiota beets need immediate immersion in Citric Acid water bath to avoid ruining by blackening once they begin to dry out.

Carrots (White, Purple, Yellow, Magic (Purple Outside with Orange, Yellow or Both Color Flesh Inside) Standard Carrot)

Carrots do not require citric acid unless you are using white variety or want to brighten the magic variety color variations. Cross cutting carrots will only produce usable pieces if you silica gel them because they shrink to tiny pieces that fall through the drier easily when slow drying. Lengthwise cut is used when dryer is used. Carrots dried at no more than 125 degrees need to be checked frequently starting at 45 minutes into the process as when they start to go to dry there is a small window of time between dry and over dried.

Eggplant (Japanese or Standard)

Keep the skin on to provide some deep purple edging along the jewelry pieces. Apply a citric acid bath to the eggplant to prevent browning. Some embodiments may omit the citric acid on the standard eggplant in order to create a brown marble texture/color that resembles marble or granite in the finished jewelry pieces. Preferably, the eggplant is sliced thin to reduce bulk but still thick enough as to not shred up and fall apart. Cutting lengthwise and crosswise pieces creates visual interest and various sizes of contiguous pieces for use.

Kiwis

Kiwis are challenging to slice due to their mushy consistency, but are very striking visually when finished due to seed patterns and veins. Preferably, select the firmest "greenest" fruit available and slice and preserve immediately, slicing as thin as possible. Preferably peel kiwi prior to slicing, as it is difficult to remove the outer "hairy" ridge of peel without destroying the finished slice. Kiwi do not require citric acid bath. Be very careful when removing kiwi from the drying racks as they tend to stick and rip. Wiping plastic drying racks with a towel moistened with vegetable oil seems to help before use with kiwi.

Watermelon Radishes

Slice as thin as possible. Use silica gel treatment to maintain the size of the radish and keep a more vibrant hot pink color. If using a dryer, then use citric acid bath to prevent browning unless it is desired to create a light pink/lightly browned "tea stained" look.

Citrus Fruits

Some embodiments of the present invention use extremely thin cut segments of blood orange as inclusions to resin pieces used for rings. This provides colors that are very visually interesting.

Other Food Items

Some embodiments of the present invention use freeze-dried raspberries, green beans, or spinach as inclusions in resin molded pieces. Other embodiments include the use of spices and seeds such as Star Anise, poppy seeds and green, pink and black peppercorns for use as resin inclusions. Other embodiments of the present invention use glycerin preserved leaves, orchids, roses and flowers as inclusions in ecopoxy resin and as ecopoxy clear coated items added to jewelry designs.

Spices

Some embodiments of the present invention utilize various ground spices such as, without limitation, cumin, curry, and cinnamon to serve as an organic powder pigment, and are mixed with an oil such as linseed oil and resin to produce an organic powder pigment compound that serves as "paint" to draw onto a vegetable "canvas" then clear coating it to produce a final completely unique organic art jewelry piece. In other embodiments of the present invention, the pigment powder itself is used as a medium with vegetables as a "canvas" on which the unique artwork is painted using the pigment powder. In other embodiments, freeze-dried vegetable powders are used as "organic pigment powder" to "paint" onto vegetables as a "canvas." Then a clear coat is applied to the final piece of unique art jewelry. The organic pigment powder compound may be applied as a layer to the surface of any of the aforementioned embodiments described to provide additional aesthetic effects. See, for example, organic pigment 520 on FIG. 5.

As can now be appreciated, embodiments of the present invention provide for a novel method of making jewelry from organic materials. Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A method for fabricating jewelry comprising organic material, comprising:

preserving the organic material;

applying a clear resin to the preserved organic material;

forming a metal blank into a formed shape;

applying the preserved organic material to the formed metal blank; and exposing an area of the metal blank by removing a portion, comprising another formed shape, of the organic material from the organic material applied to the metal blank.

2. The method of claim 1, wherein the preserving comprises applying a silica treatment to the organic material.

3. The method of claim 1, wherein the preserving comprises drying the organic material in a dehydrator at a temperature ranging from about 130 degrees Fahrenheit to about 155 degrees Fahrenheit.

4. The method of claim 1, wherein forming the organic material comprises forming a layer of at least one of eggplant, kiwi, carrots, and watermelon radish.

5. The method of claim 1, further comprising:

grinding raised portions of the organic material to create a flat surface comprising ground portions;

applying a clear resin to the ground portions of the organic material; and applying an organic powder pigment compound to the organic material.

6. The method of claim 1, further comprising:

applying an anti-stick coating to a drying board comprising a plurality of hooks;

hanging the organic material on the plurality of hooks; and repositioning the organic material after a predetermined time interval to avoid adherence of the organic material to the drying board.

7. The method of claim 1, wherein the blank is a solid form.

8. The method of claim 1, wherein applying preserved organic material to the formed shape comprises applying at least one of eggplant, kiwi, and watermelon radish.

9. The method of claim 1, further comprising applying an organic powder pigment compound to the preserved organic material.

10. The method of claim 9, wherein applying an organic powder pigment compound comprises applying an organic powder pigment compound comprising at least one of cinnamon and cumin.

11. The method of claim 2, wherein the silica treatment further comprises placing the organic material in a microwave oven operating at full power for one minute.

12. The method of claim 3, further comprising removing a plurality of bubbles from the resin.

13. The method of claim 1, wherein the organic material comprises carrots.

14. The method of claim 1, wherein the organic material comprises beets.

15. The method of claim 1, wherein the organic material comprises apples.

16. The method of claim 1, wherein the organic material comprises oranges.

17. The method of claim 1, wherein the organic material comprises limes.

18. The method of claim 1, wherein the organic material comprises flower petals.

19. The method of claim 1, wherein removing a portion of the organic material to reveal an area of the metal blank comprises removing at least one of: a heart-shaped portion, a crescent-shaped portion, a circle-shaped portion, and a cross-shaped portion.

20. The method of claim 2, wherein the organic material comprises white beets.

21. The method of claim 2, wherein the organic material comprises Chiota beets.

22. The method of claim 21, further comprising cutting the Chiota beets on multiple planes, thereby creating a unique pattern of red and white flesh.

23. The method of claim 6, wherein:

wherein the organic material comprises at least kiwi; and wherein applying an anti-stick coating to a drying board comprising a plurality of hooks comprises wiping the drying board with a towel moistened with vegetable oil.

24. The method of claim 1, further comprising including at least one of Star Anise seeds, poppy seeds, peppercorns, and glycerin-preserved leaves in the resin.

* * * * *